US006588045B2

(12) United States Patent
Fernandez

(10) Patent No.: US 6,588,045 B2
(45) Date of Patent: Jul. 8, 2003

(54) ROLLER SELF-WRINGING SPONGE MOP WITH SCRUBBER

(75) Inventor: Juan Fernandez, Ridgefield Park, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 1 day.

(21) Appl. No.: 09/849,858

(22) Filed: May 4, 2001

(65) Prior Publication Data

US 2002/0162573 A1 Nov. 7, 2002

(51) Int. Cl.[7] ..... A47L 13/12

(52) U.S. Cl. ..... 15/119.2; 15/118; 15/119; 15/116.1; 15/116.2; 15/228

(58) Field of Search ..... 15/119.2, 116.1–116.2, 15/118, 119, 228, 229.6, 244.2, 144.1–144.2, 154.2

(56) References Cited

U.S. PATENT DOCUMENTS

| | | | | | |
|---|---|---|---|---|---|
| 2,644,184 | A | * | 7/1953 | Bem | 15/154.2 |
| 2,740,146 | A | | 4/1956 | Vaughn | 15/119 |
| 2,761,162 | A | * | 9/1956 | Harris | 15/119.2 |
| 4,864,675 | A | | 9/1989 | Jones | 15/119 A |
| 5,381,579 | A | | 1/1995 | Sartori | 15/119.2 |
| 5,416,945 | A | * | 5/1995 | Price | 15/118 |
| 5,488,750 | A | | 2/1996 | Vosbikian et al. | 15/119.2 |
| 5,533,226 | A | | 7/1996 | Brown, Jr. | 15/119.2 |
| 6,000,087 | A | | 12/1999 | Petner | 15/119.2 |
| RE36,635 | E | | 4/2000 | Vosbikian et al. | 15/119.2 |
| 6,112,359 | A | | 9/2000 | Kaleta | 15/142 |
| 6,216,307 | B1 | * | 4/2001 | Kaleta et al. | 15/106 |
| 6,260,226 | B1 | * | 7/2001 | Specht | 15/119.1 |

* cited by examiner

*Primary Examiner*—Robert J. Warden, Sr.
*Assistant Examiner*—Shay L Balsis
(74) *Attorney, Agent, or Firm*—Lerner, David, Littenberg, Krumholz & Mentlik, LLP

(57) ABSTRACT

A sponge mop is fitted with a wringing device. The wringing device includes a sleeve that slidably surrounds the handle of the mop. A roller is attached to the sleeve and is spaced from the sleeve. A drive member is pivotally attached at one end to the mop head and at the other end to a small slide block that slides on a handlemounted rail. The slide block bears against a portion of the sleeve housing with adequate pressure so that downward movement of the sleeve moves the slide block and thus the drive member, thus effecting the rotation of the mop head by, ultimately, 90 degrees such that the sponge is positioned with its cleaning face parallel to the axis of the handle. Further downward travel of the sleeve allows the roller on the device to expel water held by the sponge. A scrubber/scraper is attached to the mop head at the end which is remote from the handle when the mop head is generally aligned with the handle.

18 Claims, 5 Drawing Sheets

ROLLER SELF-WRINGING SPONGE MOP WITH SCRUBBER

BACKGROUND OF THE INVENTION

The present invention relates generally to mops for cleaning floors and other surfaces, and more specifically to a self-wringing mop in which the wringing device is self-contained as part of the mop, and a mop having a scrubbing material in addition to an absorbent material.

Self-wringing mops of various types and configurations are well-known. Many mop designs have a quite effective wringing action to expel water and dirt during use. Unfortunately, not much emphasis has been placed on reducing the effort in effecting the wringing action, resulting in mop designs by reason of which the user may become easily exhausted in using the wringing device. There is also room in the art for improvement of the amount of water expelled from the sponge during the wringing action. In part, the present invention focuses on the minimization of the force and effort required to effectively wring the mop, as well as the maximization of wringing power to more effectively and more completely dry the absorbent material.

Additionally, there are many mop designs that include brushes or abrasive scrubbing surfaces in addition to the absorbent material. See, for example, the butterfly sponge mop in U.S. Pat. No. 5,488,750. However, the orientation and positioning of the scrubbing services makes it difficult and awkward to utilize the scrubbing surface. The present invention is also directed to the orientation and positioning of the scrubbing surface so as to permit for more effective and less awkward scrubbing action.

SUMMARY OF THE INVENTION

The mop apparatus in accordance with the present invention includes an elongate handle, a mop head attached to the elongate handle and an absorbent material associated with a substrate of the mop head, and a mop head actuator disposed for movement with respect to the elongate handle, and a drive member associated with said actuator and the substrate to rotate the substrate with respect to the handle when the actuator is moved, whereby an acute angle or no angle is between the axis of the mop head and the handle. In another aspect of the invention, the mop also includes a ringing device associated with the mop head actuator to compress the absorbent material upon movement of the actuator. Preferably, the wringing device is a roller spaced from the handle a distance less than the greatest distance between a portion of the absorbent material and the handle, so that the absorbent material is compressed as the roller is moved by the actuator. In another aspect of the present invention, the actuator includes a mop head receiving portion in which the roller is carried. Also, in another aspect of the present invention, the substrate preferably includes a handle groove for receiving a portion of the handle.

In another aspect of the present invention, the handle is pivotally attached to the mop head to permit pivotal movement of the mop head with respect to the handle, whereby the top surface of the mop head defines a plane that is moved pivotally with respect to the handle axis.

Another aspect of the present invention is directed to a secondary cleaning implement being provided in addition to the absorbent material. Preferably, the secondary cleaning implement is attached to a portion of the mop head so that the secondary cleaning implement is remote from the handle when the substrate is rotated by the mop head actuator.

Preferably, the secondary cleaning implement includes a scraper and/or an abrasive pad.

In another aspect of the present invention, the drive member is a rod connected between the actuator and the mop head or substrate thereof. Still further, the mop head actuator may include a drive member channel and a slide rail attached to the elongate handle, the slide rail being aligned with the drive member channel, and a slide block connected to the slide rail. The drive member may be connected to the slide block, and the slide block is sized so that it bears against the drive member channel and is driven with the drive member for at least a portion of the movement of the mop head actuator. Most preferably, the drive member is able to rotate the substrate through 90 degrees so that there is no angle between the mop head axis and the elongate handle.

In a further embodiment of the present invention, the present invention includes an elongate handle having first and second ends, a mop head attached to the elongate handle, and absorbent material normally remote from the first end of the handle. The mop head has a length normally extending transverse to a handle along a mop head axis between the first and second side portions of the mop head. A secondary cleaning implement in addition to the absorbent material is attached to the first side portion of the mop head. A mop head actuator is disposed for movement with respect to the elongate handle, and a drive member is associated with the actuator and the substrate to rotate the substrate with respect to the elongate handle when the actuator is moved, whereby an acute angle or no angle is formed between the mop head axis and the elongate handle. At this position, the secondary cleaning implement is remote from the first end of the elongate handle.

In another aspect of the present invention, the secondary cleaning implement has a cleaning surface that is arranged at an angle with respect to the elongate handle. Preferably, the secondary cleaning implement includes a scraper and/or an abrasive cleaning material.

In still another embodiment of the present invention, a method is provided for cleaning with a mop having an elongate handle and a mop head attached to the handle. It includes stabilizing the elongate handle with one hand, moving a mop head actuator downward on the elongate handle with the other hand to rotate the mop head through an angle between one and ninety degrees as measured between the long axis of the mop head and the elongate handle. Preferably, the rotation through an angle of one and ninety degrees includes rotating the mop head so that the long axis of the mop head is at zero degrees between the long axis of the mop head and the elongate handle axis. Preferably, the mop head actuator is continually moved downward so that a roller or other expedient compresses the absorbent material of the mop head. In yet another aspect of the present invention, the rotation of the mop head through an angle between one and ninety degrees is accomplished so that the mop head is at zero degrees as measured between the long axis of the mop head and elongate handle, as well as providing a secondary cleaning implement in addition to the absorbent material, and locating the secondary cleaning implement on a portion of the mop head that is remote from the elongate handle when the mop head is at zero degrees, and then utilizing the secondary cleaning implement when the mop head is at zero degrees in order to clean a surface.

In another arrangement, the present invention is comprised of a self-wringing mop, which includes an absorbent material in some form, preferably a foam sponge. The mop is fitted with a wringing device having a handle, a mop head, a sleeve capable of sliding along the handle, and a roller attached to the sleeve. A drive member is pivotally attached at one end to the mop head body and pivotally attached at the other end to a small sliding block that slides on a handle-mounted rail, all of which are designed as parts of a mop head turning mechanism. The rail is mounted in such a position that the sliding block presses against the inner wall of the housing of the wringing device with adequate pressure to create friction between the sliding block and the housing. The wringing action starts when the user moves the wringing device from its uppermost position toward the mop head along the handle. With the movement of the sleeve, the mop head turning mechanism is activated and the mop head is preferably rotated by 90 degrees such that the sponge is positioned with its cleaning face parallel to the axis of the handle. For some cleaning applications, such as on an otherwise difficult to reach surface, the sponge mop can be utilized to clean while in position for wringing (i.e., parallel to the handle). Further downward travel of the sleeve allows the roller on the sleeve to roll over the sponge with adequate pressure, such that liquid held by the sponge is squeezed toward one side of the sponge and eventually expelled from the sponge. This design allows the wringing of the sponge mop with minimum effort compared to many other mop designs.

To enhance the cleaning capability of the mop, a scrubber, which preferably includes a scrubbing blade and/or a piece of abrasive material, is attached to one end of the mop head. This scrubber can be used at any time and with the scrubber in any orientation with respect to the handle. It may, however, be most useful when the wringing device is pushed to the lowest position of its travel, changing the orientation of a conventional sponge mop head into an orientation in which the scrubber is remote from the mop handle, whereby the scrubbing of stains or dirt on floors or other surfaces is facilitated.

DETAILED DESCRIPTION OF THE PREFERRED EMBODIMENTS

Figure 1:
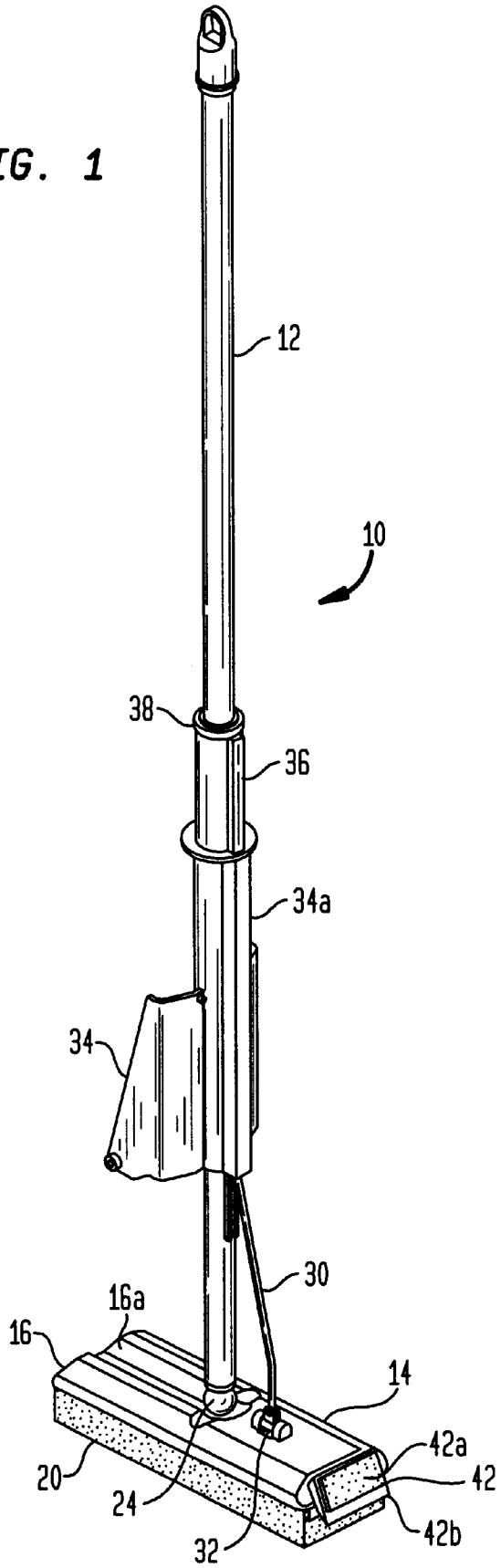
FIG. 1 is an isometric front view of the mop of the present invention, set in an operating mode that is to be used as a normal sponge mop.
Figure 2:
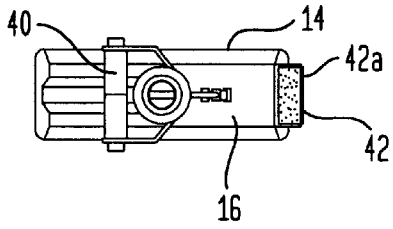
FIG. 2 is a top elevational view of the mop set in an operating mode that is to be used as a normal sponge mop.

The self-wringing sponge mop, generally designated as 10 in accordance with the present invention, includes an elongate round handle 12, which can be made of a metal or a plastic tube, or of any other suitable material or in any other suitable shape. The handle 12 may be a two-piece handle by which the two pieces are joined and connected in any suitable manner, such as by a tapered screw connection, a telescoping connection arrangement, a sliding sleeve for stiffening the joint, etc.

Referring to the figures, and in particular FIGS. 1–5, a mop head 14 includes a housing 16 which is constructed as an inverted tray into which a relatively thin substrate 18 (shown in FIG. 5) can be fixed. Preferably, the substrate 18 is removably fixed to the tray. The sponge 20 of the mop head 14 may be fixed to the substrate 18 by adhesive, although other methods of fixation can be used. The sponge herein is preferably an absorbent and relatively soft foam, of any desired porosity. However, any suitable absorbent material may be used. Preferably, the mop head 14, or at least the primary structural portions thereof, are rectangular in shape, though any suitable shape may be used.

The mop head housing 16 additionally includes a handle groove 16*a* for receiving a portion of the handle 12 when the mop head 14 is turned 90 degrees so that the longitudinal axis of the mop head 14 and the longitudinal axis of the handle 12 are generally parallel as is shown in FIGS. 6–9, and as will be discussed further below.

The mop head housing 16 is attached to the handle 12 by capturing a ball-shaped projection 22 on the housing 16 with a ball socket joint 24, the ball socket joint being made up of two halves 24*a* and 24*b*. The ball socket joint 24 includes a tubular connection portion that attaches to the handle 12 by an interference fit.

Figure 3:
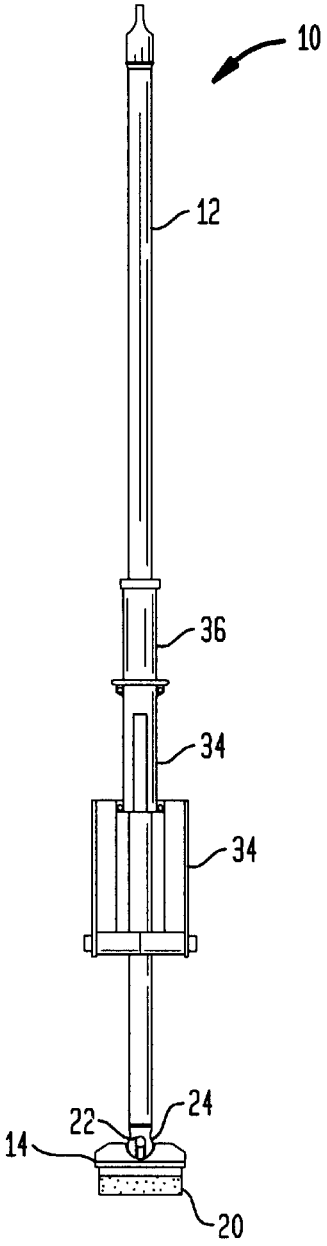
FIG. 3 is a left side elevational view of the mop set in an operating mode that is to be used as a normal sponge mop.
Figure 4:
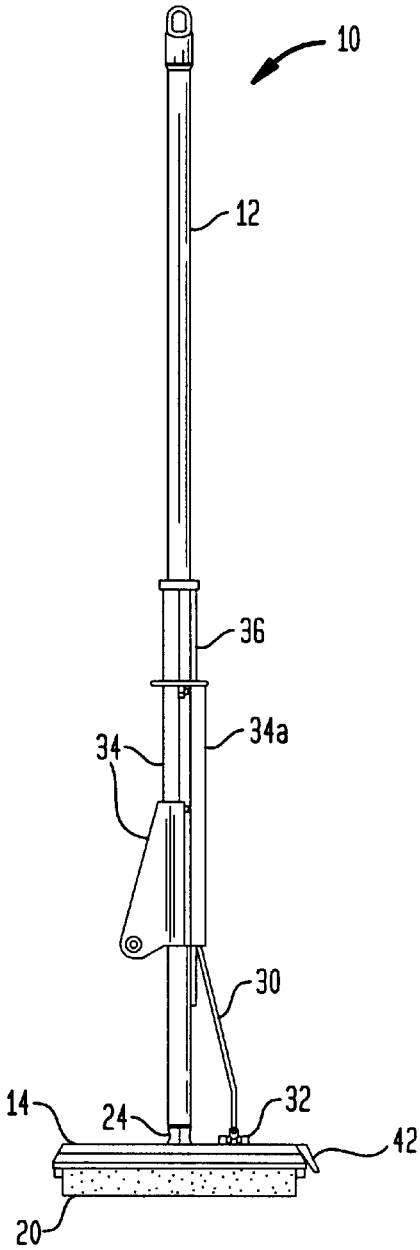
FIG. 4 is a front elevational view of the mop set in an operating mode that is to be used as a normal sponge mop.
Figure 5:
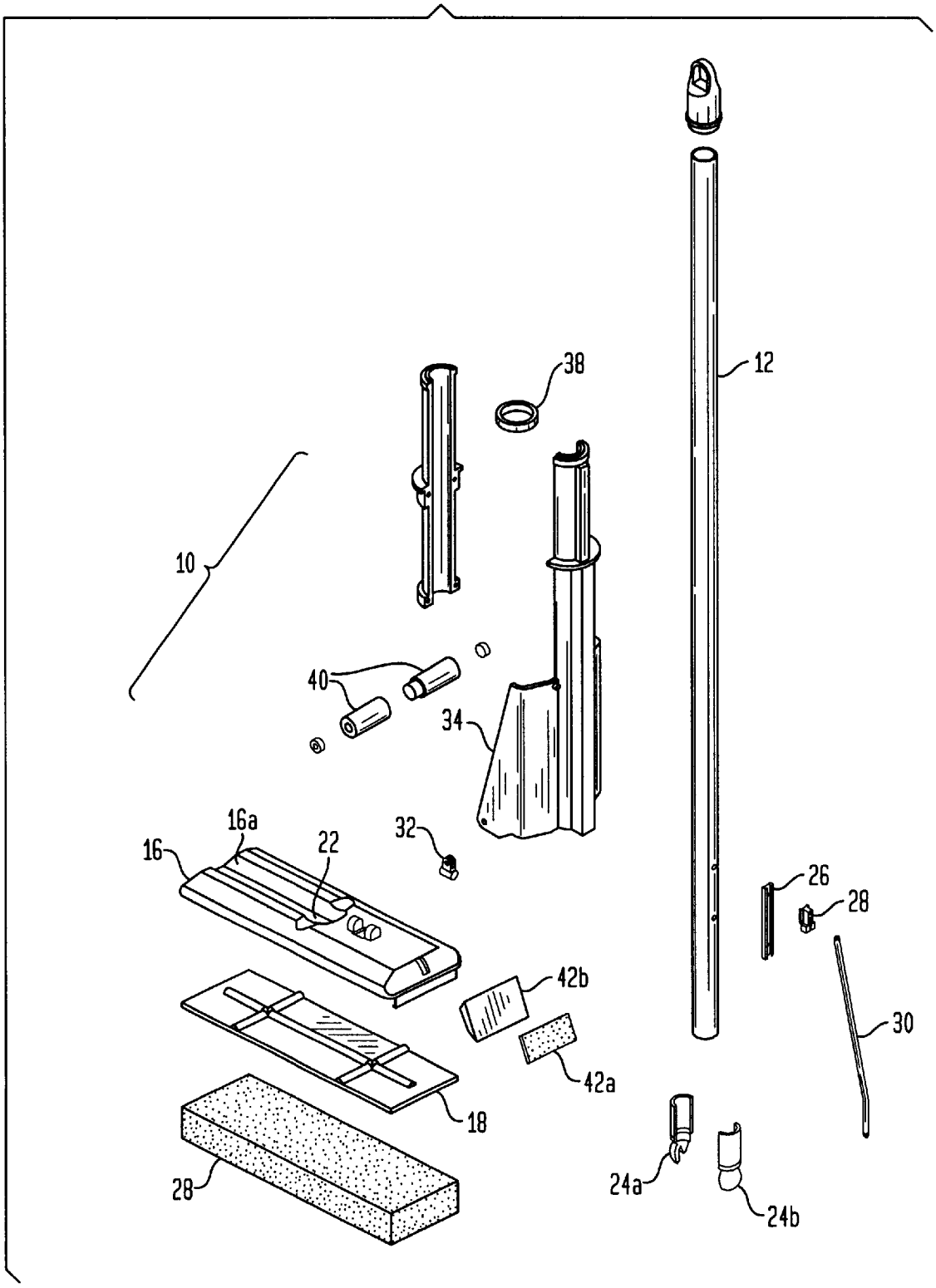
FIG. 5 is an exploded perspective view of the mop showing components of the mop.

Guide grooves on the ball socket joint 24, one of which can be seen in part in FIG. 3, are provided so that the mop head housing 16 can swivel within the desired range of positions. Four guide grooves may be provided to permit movement in four directions. Of course, any suitable expedient may be used to permit appropriate movement of the mop head 14.

The mop head housing 16 is preferably set at an angle to the handle 12, such that the plane defined by the top surface of the housing 16 is angled with respect to the handle 12 at an angle other than 90°. Thus, when the mop surface is placed flat on the floor, the handle 12 is angled, ergonomically, toward the user in position to use.

A small rail 26, made either with metal or plastic, is attached firmly to the handle 12 of the mop 10. A small sliding block 28 is associated with the small rail 26 for slidable movement along the rail's long axis. Movement of the block 28 is, however, restrained in other directions. A drive member 30, preferably thin and metal rod, is designed with one end pivotally attached to the sliding block 28 and the other end pivotally attached to a small swiveling block 32, which is, in turn, pivotally attached to the mop head housing 16. The drive member 30 is slightly bent towards the mop head 14 in order to facilitate the rotation of the mop head 14 through an angle of 90 degrees, all in association with the pivoting and sliding arrangement with the rail 26 and block 28. To facilitate this rotation, the block 28 is sized with respect to a portion of the sleeve 34, as will be described below. The pivotal attachment of the small swiveling block 32 to the mop head housing 16 enables the user to flex the mop head 14 in directions perpendicular to the longitudinal axis of the mop head 14. The guide grooves in the ball socket joint 24 permit this movement.

The wringing mechanism of the self-wringing sponge mop 10 includes not only the slide rail 26, slide block 28 and rod drive member, but also includes a sliding sleeve 34. The sliding sleeve 34 includes two parts surrounding the handle 12. These parts are assembled by screws and a locking ring 38, or in any other suitable manner. The sliding sleeve 34 includes a pair of flanges extending transversely to the longitudinal axis of the handle 12. The flanges are spaced to accept the depth of the mop head 14 when the mop head 14 is turned 90 degrees, as described below and as shown in Figures 6–9. These flanges also hold a roller 40, which is mounted between the flanges by rotatably fixing halves of the roller 40. After the sliding sleeve 34 and roller 40 are assembled, the assembly can slide freely up and down the handle 12 when a user holds the sleeve by the grip 36 provided on the upper portion of the sleeve assembly. The roller 40 facilitates the wringing of the sponge in an efficient manner.

The sleeve 34 includes a drive member channel 34*a*, which surrounds and houses the slide rail 26, slide block 28 and drive member 30. The slide block 28 is sized so as to bear against the inside of the drive member channel 34*a* of the sleeve 34. As the sleeve 34 is slid downward towards the mop head 14 the friction between the drive member channel 34*a* and the slide block 28 causes the slide block to also move along the rail 26. This action causes the drive member 30 to push one side of the mop head 14 downward, whereby the mop head 14 rotates about the ball socket joint 24 thus turning the mop head 14 through, preferably, 90 degrees. When the mop head 14 turns 90 degrees, and the handle 12 is partially within the handle groove 16*a*, the sleeve 34 can be continually pushed downward so that the roller 40 engages the sponge 20. At this point, since the mop head 14 can no longer rotate, the friction of the drive member channel 34*a* and the slide block 28 is overcome, and the drive member channel 34*a* continues over the drive member 30. As the sleeve 34 is pushed downward, the roller 40 expels the liquid from the sponge 20. One of the advantages to this arrangement is that the pressure applied by the roller 40 to the sponge 20 can be controlled by the sizing of the sleeve 34 and positioning of the roller 40 with respect to the sleeve 34. That is, the closer the roller 40 is positioned with respect to the drive member 30 and mop head 14, the greater the wringing power to expel liquid from the sponge.

The above described wringing action is illustrated in FIGS. 6–9.

Another aspect of the present invention relates to the provision of a scrubber and scraper. The scrubber and scraper, generally designated as 42, is provided on the narrow end of the mop head 14. It is on the end which will be remote from the handle 12 when the mop head 14 is turned so that the mop head 14 and the handle 12 are generally aligned. This scrubber/scraper 42 includes a scrubbing material 42*a* and a scraper edge 42*b*. The scrubber/scraper 42 is preferably attached to the mop head 14 in a removable manner, such as by projections that slide within undercuts on the end of the mop head 14 and are held tightly by an interference fit. Of course, any suitable manner of attaching, preferably removably attaching, the scrubber/scraper 42 is acceptable. As can be best seen in FIG. 4, the scrubber/scraper 42 is positioned such that the scrubbing surface is at an angle to the handle 12. This facilitates the cleaning action when the mop head 14 is in the rotated position, i.e., generally parallel to the handle 12. Thus, the user can hold the handle 12 at an angle which is comfortable for the user while scrubbing or scraping stains or dirt or food particles from a floor or other surface. Thus, the angled orientation of the scrubber/scraper 42 provides for an ergonomically efficient cleaning action.

The removability of the scrubber/scraper 42 enables the user to replace spent scrubber/scrapers or to replace them with other suitable cleaning implements, perhaps a more abrasive or less abrasive scrubber. It also facilitates the cleaning of the scrubber/scraper 42.

The abrasive pad 42*a* can be of any suitable type, including interlocking fibers typically used in cleaning implements or hard short bristles also typically used in cleaning implements.

To further assist in the cleaning action when utilizing the scrubber/scraper 42, the sleeve 34 can be provided with a stop or boss member in order to stop or at least retard the downward motion of the sleeve 34 when the mop head 14 is moved to an intermediate angle, i.e., between 90 degrees and 0 degrees as measured between the longitudinal axis of the mop head 14 and the longitudinal axis of the handle 12. At such an angle, the scrubber/scraper 42 may be at a position with respect to the handle 12 that is more easily manipulated by a user. This would assist in the scrubbing action when using the scrubber/scraper 42. This may assist the user whether or not the scrubber/scraper 42 is disposed at an angle as shown in the drawings. In other words, the scrubber may be provided at no angle to the side of the narrow portion of the mop head 14, yet rotation between 90 degrees and 0 degrees provides for an ergonomic orientation for more efficient cleaning action.

Figure 6:
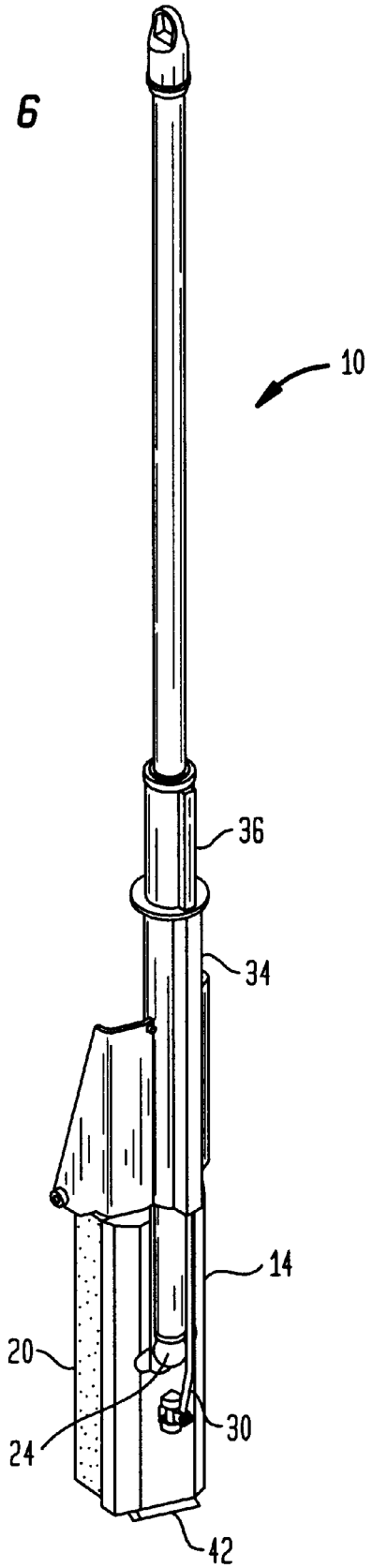
FIG. 6 is an isometric front view of the mop of the present invention, set in an operating mode that is at the beginning of the movement of the wringing device in carrying out the wringing action.
Figure 7:
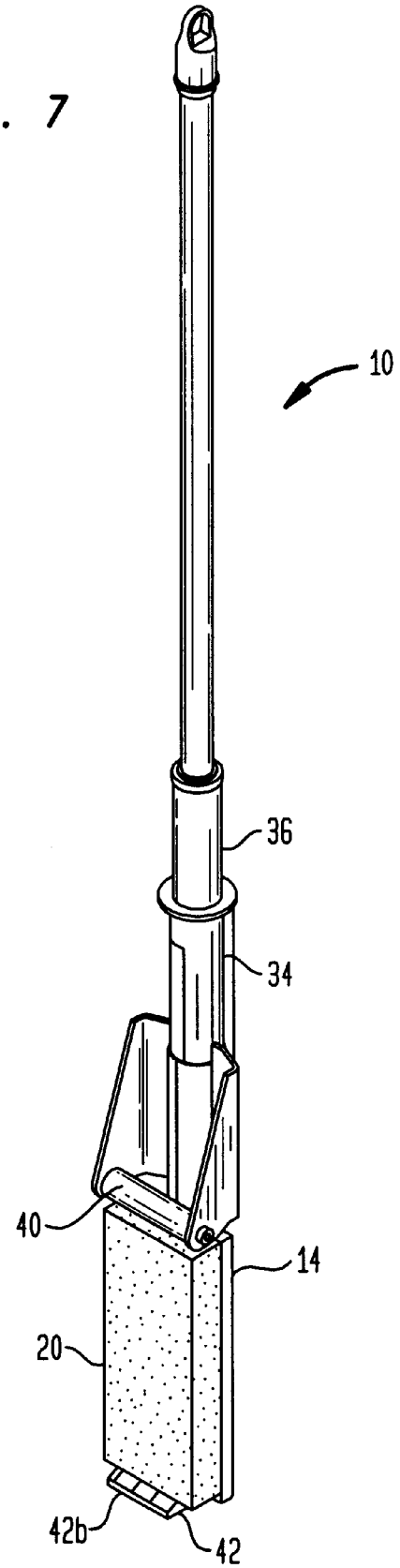
FIG. 7 is an isometric left-hand view of the mop of the present invention, set in an operating mode that is at the beginning of the movement of the wringing device in carrying out the wringing action.
Figure 8:
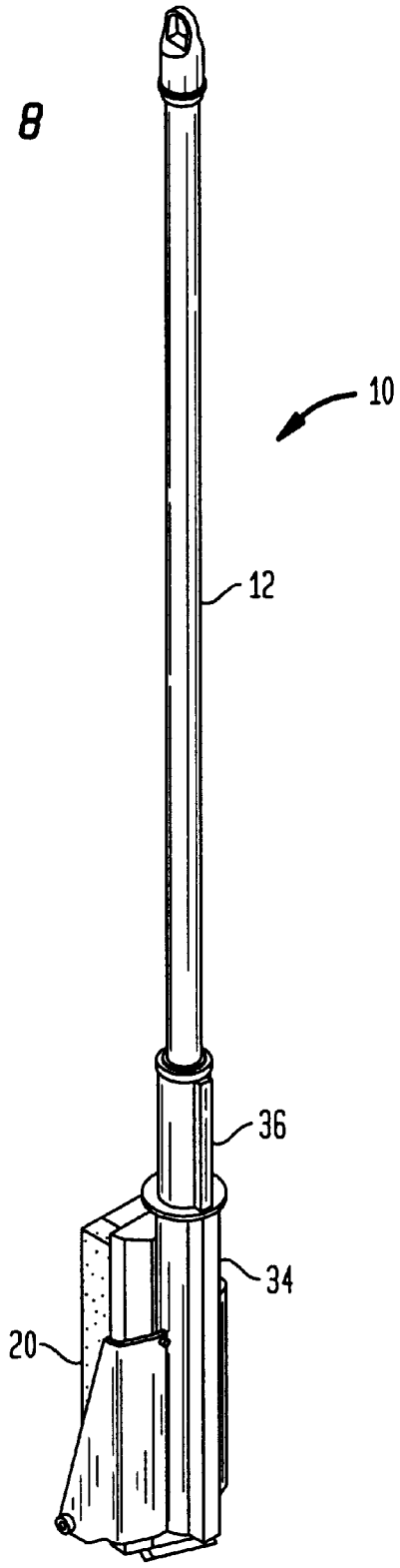
FIG. 8 is an isometric front view of the mop of the present invention, set in an operating mode that is at the end of the movement of the wringing device in carrying out the wringing action.
Figure 9:
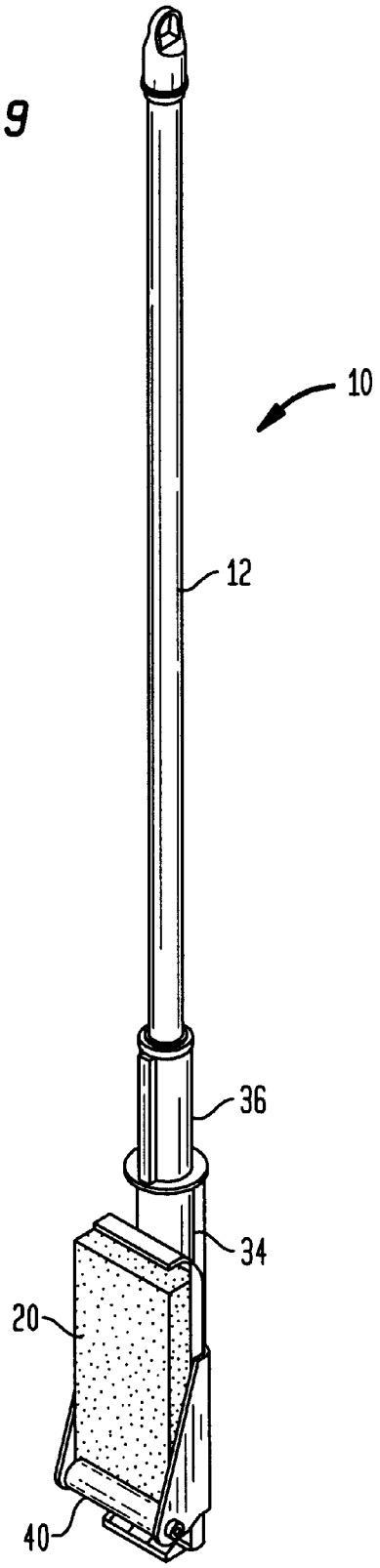
FIG. 9 is an isometric left-hand side view of the mop of the present invention, set in an operating mode that is at the end of the movement of the wringing device in carrying out the wringing action.

In order to wring the sponge of the mop 10, the user can hold the mop with the handle 12 in a generally vertical position. The user then holds the grip 36 of the sliding sleeve 34, and begins to slide the sleeve 34 downwards. When the sliding sleeve 34 moves, the friction between the sliding block 28 and the drive member channel 34*a* drags and thus moves the sliding slide block 28 along the slide rail 26. Thus, the drive member 30 is pushed downward and forces the mop head 14 on one side (opposite the handle groove 16*a*), thus turning the mop head 14. In order to position the mop head 14 for wringing, the sleeve 34 is pushed further until the mop head 14 and the handle 12 are generally aligned. That is, the mop head 14 rotates through 90 degrees so that the angle between the mop head 14 and the handle 12 is generally 0 degrees. FIGS. 6 and 7 show the orientation of the mop head 14 in relation to the handle 12. Here, the roller 40 is in position just above or at the top of the sponge 20. When the user continues to move the sleeve 34 downward, the roller 40 depresses the sponge 20 because of the spacing of the roller 40. Water is expelled from the sponge to that part of the sponge which has not yet been depressed by the roller 40, or out of the sponge 20 altogether. Eventually, most of the water inside of the sponge 20 is expelled and the sponge becomes reasonably dry. When water is required on the mop, the sponge can be dipped in a bucket of water in order to absorb an adequate amount of water for the desired cleaning job. The cycle of expelling water from the sponge 20 and allowing the sponge to absorb water from a water container can be repeated several times as needed to achieve the desired cleaning action with the sponge mop.

Although the invention herein has been described with reference to particular embodiments, it is to be understood that these embodiments are merely illustrative of the principles and applications of the present invention. It is therefore to be understood that numerous modifications may be made and are encouraged to be made to the illustrative embodiments, and that other arrangements may be devised without departing from the spirit and scope of the present invention as defined by the claims below.

What is claimed is:

1. A mop comprising:

a. an elongate handle;

b. a mop head attached to said elongate handle, said mop head having a substrate with a mop head axis and an absorbent material associated with said substrate;

c. a mop head actuator disposed for movement with respect to said elongate handle;

d. a drive member associated with said actuator and said substrate to rotate said substrate with respect to said elongate handle when said actuator is moved, whereby an acute angle or no angle is formed between said mop head axis and said elongate handle when said actuator is moved toward said mop head;

e. a wringing device associated with said mop head actuator to compress said absorbent material upon movement of said actuator, so that liquid inside of absorbent material will be expelled.

2. The mop in claim 1, wherein said wringing device is a roller spaced from said elongate handle a distance less than the greatest distance between a portion of the absorbent material and said elongate handle, so that said absorbent material will be compressed as the roller is moved by said actuator.

3. The mop in claim 2, wherein said actuator includes a mop head receiving portion, and said roller is carried by said mop head receiving portion.

4. The mop in claim 3, wherein said substrate includes a handle groove for receiving a portion of said handle.

5. The mop in claim 4, wherein said handle is pivotally attached to said mop head to permit pivotal movement of the mop head with respect to said handle.

6. The mop in claim 2, further including a secondary cleaning implement in addition to said absorbent material, said secondary cleaning implement being attached to a portion of said mop head such that said secondary cleaning implement is remote from said handle when said substrate is rotated by said mop head actuator.

7. The mop in claim 1, further including a secondary cleaning implement in addition to said absorbent material, said secondary cleaning implement being attached to a portion of said mop head such that said secondary cleaning implement is remote from said handle when said substrate is rotated by said mop head actuator.

8. The mop in claim 7, wherein said secondary cleaning implement includes a scraper.

9. The mop in claim 1, further including a secondary cleaning implement in addition to said absorbent material, said secondary cleaning implement being attached to a portion of said mop head such that said secondary cleaning implement is remote from said handle when said substrate is rotated by said mop head actuator.

10. The mop in claim 1, wherein said mop head actuator includes a drive member channel, and further including a slide rail attached to said elongate handle and aligned with said drive member channel, and a slide block slidably connected to said slide rail, said drive member being connected to said slide block, and whereas said slide block is sized with respect to said drive member channel such that it bears against a portion of said drive member channel and is driven with said drive member for at least a portion of the movement of said mop head actuator.

11. The mop in claim 1, wherein said drive member rotates said substrate through 90 degrees so that there is no angle between said mop head axis and said elongate handle.

12. A mop for cleaning a surface comprising:

a. an elongate handle having first and second ends;

b. a mop head attached to said elongate handle, said mop head having an absorbent material normally remote from said first end of said handle, said mop head also having a length normally extending transverse to said handle along a mop head axis between first and second side portions of said mop head;

c. a secondary cleaning implement in addition to said absorbent material attached to said first side portion of said mop head;

d. a mop head actuator disposed for movement with respect to said elongate handle;

e. a drive member associated with said actuator and said substrate to rotate said substrate with respect to said elongate handle when said actuator is moved, whereby an acute angle or no angle is formed between said mop head axis and said elongate handle wherein said secondary implement cleaning implement is positioned to clean the surface when said actuator is moved toward said mop head.

13. The mop in claim 12, wherein said secondary cleaning implement has a cleaning surface, and said cleaning surface is arranged at an angle with respect to said elongate handle.

14. The mop in claim 12, wherein said secondary cleaning implement includes a scraper and an abrasive cleaning material.

15. A mop comprising:

a. an elongate handle;

b. a mop head attached to said elongate handle, said mop head having a substrate with a mop head axis and an absorbent material associated with said substrate;

c. a mop head actuator disposed for movement with respect to said elongate handle, said actuator pivotally attached to said mop head to allow pivoting motion transverse to the direction of rotation of the mop head as rotated by the movement of the actuator;

d. a drive member associated with said actuator and said substrate to rotate said substrate with respect to said elongate handle when said actuator is moved, whereby an acute angle or no angle is formed between said mop head axis and said elongate handle when, said actuator is moved toward said mop head.

16. The mop in claim 15, further comprising a wringing device associated with said mop head actuator to compress said absorbent material upon movement of said actuator, so that liquid inside of said absorbent material will be expelled.

17. A mop comprising:

a. an elongate handle;

b. a mop head attached to said elongate handle, said mop head having a substrate with a mop head axis and an absorbent material associated with said substrate;

c. a mop head actuator disposed for movement with respect to said elongate handle;

d. a drive member associated with said actuator and said substrate to rotate said substrate with respect to said elongate handle when said actuator is moved, whereby an acute angle or no angle is formed between said mop head axis and said elongate handle when said actuator is moved toward said mop head;

e. wherein said substrate includes an integrally molded handle groove for receiving a portion of said handle.

18. A mop comprising:

a. an elongate handle;

b. a mop head attached to said elongate handle, said mop head having a substrate with a mop head axis and an absorbent material associated with said substrate;

c. a mop head actuator disposed for movement with respect to said elongate handle;

d. a drive member associated with said actuator and said substrate to rotate said substrate with respect to said elongate handle when said actuator is moved, whereby an acute angle or no angle is formed between said mop head axis and said elongate handle when said actuator is moved toward said mop head;

e. wherein said mop head is substantially rectangular, the major axis being along the long sides of the rectangle and wherein said handle is attached to said mop head in substantially the middle of the long sides of the rectangle and said actuator is connected to said mop head along the major axis.

* * * * *

UNITED STATES PATENT AND TRADEMARK OFFICE

CERTIFICATE OF CORRECTION

PATENT NO. : 6,588,045 B2
DATED : July 8, 2003
INVENTOR(S) : Juan Fernandez

It is certified that error appears in the above-identified patent and that said Letters Patent is hereby corrected as shown below:

Title page,
Item [57], ABSTRACT,
Line 6, "handlemounted" should read -- handle-mounted --.

Column 8,
Line 23, delete "implement".

Signed and Sealed this

Eighteenth Day of November, 2003

JAMES E. ROGAN
*Director of the United States Patent and Trademark Office*